US008191687B2

(12) United States Patent
Lary et al.

(10) Patent No.: US 8,191,687 B2
(45) Date of Patent: Jun. 5, 2012

(54) ZIPPER LUBRICATING DEVICE

(75) Inventors: Banning Gray Lary, Miami, FL (US); Todd P. Lary, Homestead, FL (US)

(73) Assignee: Lary Research & Development, LLC, Miami, FL (US)

( * ) Notice: Subject to any disclaimer, the term of this patent is extended or adjusted under 35 U.S.C. 154(b) by 193 days.

(21) Appl. No.: 12/648,717

(22) Filed: Dec. 29, 2009

(65) Prior Publication Data

US 2010/0163345 A1 Jul. 1, 2010

Related U.S. Application Data

(60) Provisional application No. 61/203,914, filed on Dec. 30, 2008.

(51) Int. Cl.
*F16N 7/00* (2006.01)

(52) U.S. Cl. ..... 184/15.1

(58) Field of Classification Search ..... 184/15.1, 184/38.1; 401/277
See application file for complete search history.

(56) References Cited

U.S. PATENT DOCUMENTS

| | | | | |
|---|---|---|---|---|
| 3,019,471 | A | 2/1962 | Bowersox | |
| 3,058,144 | A | 10/1962 | Schotsch | |
| 3,491,854 | A | 1/1970 | Baxter | |
| 3,519,099 | A | 7/1970 | Sanders | |
| 3,669,884 | A * | 6/1972 | Wright | 508/213 |
| 4,279,527 | A * | 7/1981 | Moe et al. | 401/277 |
| 5,263,787 | A | 11/1993 | Wilcox et al. | |
| 5,340,228 | A | 8/1994 | Wilcox et al. | |
| 5,857,796 | A | 1/1999 | Waldmann | |
| 6,954,970 | B2 | 10/2005 | McMahon et al. | |
| 6,979,289 | B2 | 12/2005 | McMahon et al. | |
| 2002/0069494 | A1 * | 6/2002 | McCrum | 24/429 |
| 2004/0146656 | A1 | 7/2004 | Algaze | |
| 2009/0032337 | A1 * | 2/2009 | Scott | 184/26 |

* cited by examiner

*Primary Examiner* — Michael Mansen
*Assistant Examiner* — Robert Reese
(74) *Attorney, Agent, or Firm* — McHale & Slavin, P.A.

(57) ABSTRACT

The instant invention describes a zipper lubricating applicator device for dispensing a lubricant to one or more components of a zipper. The applicator device is designed to fit various lubricant reservoirs and is capable of dispensing lubricant in the form of liquids, gels, or aerosols. The zipper lubricating applicator device contains a lubricant receiving cavity constructed and arranged to receive a lubricant reservoir. A lubricant dispensed from the lubricant reservoir is received by the lubricant receiving cavity and is directed to at least one inner lumen. The inner lumen provides a pathway for dispersal of a lubricant from the lubricant reservoir receiving cavity to a zipper receiving channel. The lubricant is dispersed at a controlled rate and to a desired portion of a zipper through the zipper receiving channel. The zipper receiving channel is constructed and arranged to provide dispensing of the lubricant to a portion of the zipper as the applicator device slidably moves upon the zipper track. The instant invention further describes systems for applying a lubricant to a zipper track.

16 Claims, 6 Drawing Sheets

ZIPPER LUBRICATING DEVICE

RELATED APPLICATION

This application claims benefit of the filing date of U.S. Provisional Application No. 61/203,914, filed on Dec. 30, 2008, the contents of which are herein incorporated by reference.

FIELD OF INVENTION

The invention describes a device that places a lubricant on the interlocking elements of a zipper fastener, more particularly, the invention describes a zipper lubricating applicator device which can be attached to lubricant reservoirs for dispensing a lubricant to the interlocking elements of a zipper as the device travels along the zipper track.

BACKGROUND OF INVENTION

The common zipper is a well known fastening device having various applications, including uses in clothing, bags, or outdoor goods. Most zippers are either made from materials which resist malfunction or are treated with materials to ensure an even sliding mechanism. However, providing a zipper that does not malfunction has yet to be accomplished. For those zipper fastening systems that encounter harsh environments, such as those zippers associated with wet suits, failure rates may be even greater. Moreover, as a zipper ages or is subjected to repetitive cleaning, the possibility of malfunction increases. Because the zipper is common to everyday uses, most people fail to recognize the need to apply preventative maintenance measures. For example, it may be necessary to apply a lubricant to ensure that the zipper retains an ability to slide along the teeth, preventing malfunction. Although the zipper is easily manufactured, the item to which the zipper may be attached may not be easily replaceable. Should the zipper become damaged or malfunction, it may be necessary to replace the entire object which could be costly or result in sentimental loss.

A common method used in preventing zippers from malfunction is the use of waxes or soaps as a lubricant. Waxes and soaps usually come in solid sticks and require the user to run the solid object over the zipper track. This method is messy and not always effective. Modern society is replete with machines that utilize moving parts. As such, commercial lubricants have developed to insure proper functioning and an increase useful life. These commercial products can be applied to zippers. However, dispensing methods are imprecise at best and applying the lubricant to unwanted areas can result in discoloration and sullying of the item. Therefore, a lubricant applicator device that can be used with commercially available lubricant reservoirs to dispense a desired amount of lubricant to a desired position within the zipper track is needed.

DESCRIPTION OF THE PRIOR ART

U.S. Pat. No. 3,019,471 discloses a zipper lubricating device for dispensing a solid lubricant. The device contains a housing which contains a slide operator and a solid lubricant. The housing contains a base plate and a generally U-shaped wall which projects from the periphery of the bottom plate. A top plate, similar in outline to the bottom plate connects to the upper edge of the generally U-shaped wall, thus creating a pocket for the slide operator and the wafer. The ends of the upper plate and the bottom plate further contain flanges which provide for the zipper element to be received within the flanged portions. In this arrangement, the flanges can be used as tracks to guide the zipper element across the solid lubricant.

U.S. Pat. No. 3,058,144 describes a lubricating zipper, particularly to an improvement of the zipper lubricator for facilitating lubrication of a clothing-type zipper. The '144 device is a cup-shaped, metal tube casing which is enclosed at the bottom end and open at the top end. A removable cap is placed on the open end to enclose the metal tube casing. Positioned within the metal tube casing is an upright copper tubing adapted to receive a supply of lubricant. In use, lubricant is supplied to the top portion of the upright copper tubing. The lubricant flows in a downward direction, exiting through an outlet opening at the bottom of the cup-shaped metal tubing. Housed within the cup-shaped metal tubing is felt padding. The padding is positioned in the space between the cup-shaped metal tubing and the upright copper tubing. Lubricant supplied to the upright copper tubing gets absorbed by the felt padding. An opening in the cup-shaped metal tubing allows for a portion of a zipper to be passed along the felt pad, thus providing a film of lubricant to the zipper teeth.

U.S. Pat. No. 3,519,099 discloses a zipper lubricator which uses a hollow block containing a piston actuated by a shaft threaded in the block. Filled within the hollow block is a lubricant. The lubricant is forced through the slot in a base plate into a groove which fits over the teeth of a zipper string.

U.S. Pat. No. 3,491,854 discloses a hand held, slide fastener lubricator device. The device contains opposing disc portions. The two disc portions have curved peripheral flanges spaced apart to receive a slide fastener between them and a body of solid wax-type lubricant fixedly held between the disc portions. The lubricant has a curved peripheral surface positioned inwardly from the peripheral edges of the disc portions. The two disc portions are connected by a portion extending through the interposed lubricant to secure it into place. Inner surfaces of the peripheral flanges of the disc portions converge inwardly to guide the fastener elements to the solid lubricant while keeping the portions of fabric to which the fasteners are attached out of contact with the lubricant as the lubricator is slid along a fastener to lubricate it.

U.S. Patent application 2004/0146656 discloses an apparatus and method for lubricating a raised or protruding surface. The apparatus includes a holder and an insert. The insert has an outer surface and at least two sections which meet along an interface. The two sections may be manually or mechanically separated when needed. A channel is formed by the separation of opposing inner surfaces along the interface, each having identical upper surfaces. The entire apparatus is formed by placing the insert into the holder. The holder has an inner cavity having expanded flanged surface which increase circumferally as it extends past a horizontal floor of an upper channel. The upper channel being formed by opposing vertical members and the horizontal floor. To use the device, a user inserts the absorbent insert into the holder. The insert is then separated to from a receiving cavity. Lubricant is then placed into the cavity. Once lubricant is added, the device is placed on a protruding surface and slide across the surface in such a manner that the protruding surface lubricates the device within the cavity.

U.S. Pat. No. 5,263,787 discloses a holder having a sealing cap portion for craft paint applicators. The holder includes a lower base portion with an interior cavity formed in the upper portion of the holder. A threaded portion is formed therein for mating engagement with a threaded portion on the applicator bottle. The interior cavity terminates in an end wall portion that seals the dispensing end of the applicator tip from air circulation and from leakage. The applicator is inserted in the interior cavity of the holder and twisted to lock the applicator tip in the holder so the applicator tip is sealed within the holder. This allows the base portion of the holder to support the applicator in a inverted position. Since the applicator is inverted, craft paint is always in fluid contact with the inner surfaces of the applicator tip. This prevents the craft paint from drying and clogging the applicator tip and also keeps any air in the applicator at the end of the applicator opposing the applicator tip to minimize the formation of air bubbles in the flow of the craft paint.

U.S. Pat. No. 5,340,228 discloses a cap for fluid applicators and particularly for craft paint applicators having fine tips. The cap includes an abutment shoulder for engaging a corresponding abutment shoulder on the applicator tip to form a first seal. A flexible shoulder is formed in the interior cavity of the cap spaced from the cap abutment shoulder. The interior cavity terminates in an end wall portion spaced from the flexible shoulder. The cap is threaded onto the applicator causing the dispensing end of the applicator tip to engage the cap end wall portion. The flexible shoulder of the interior cavity of the cap resiliently yields as the dispensing end is forced against the cap end wall portion during the continued rotation of the cap until the applicator abutment shoulder engages the abutment shoulder in the cap. The cap thus seals the applicator tip in at least two positions. The resilient yielding of the flexible shoulder portion compensates for any dimensional variation in the length of the applicator tip or cap to ensure that the cap will always seal the applicator tip without damage to the tip.

U.S. Pat. No. 5,857,796 discloses a fluid applicator with a supplemental reservoir. The applicator with reservoir is comprised of a reservoir having a threaded open top. A flow cap, having a fluid chamber therein, is threadably securable to the reservoir. A plug, seated on a plurality of prongs extends from the top of the flow cap and forms a plurality of fluid openings there between. A closure valve snap fits onto the flow cap and is thereafter free to threadably rotate about the flow cap between a normally closed and a normally open position. An applicator cap, having a fluid reservoir and an applicator tip connected by a duct, is threadably securable to the closure valve. The applicator tip can be of any appropriate design including a brush, a sponge tip, a stylus tip, a roller tip, as well as many others.

U.S. Pat. Nos. 6,979,289 and 6,954,970 disclose an improved slider for securing interlocking members of the zipper and a slider insertion apparatus. The slider insertion apparatus includes an activator with pusher, an insertion cylinder, and a zipper guide. The zipper guide and the activator with pusher are manufactured to facilitate movement of the zipper within the slider insertion apparatus, to properly position the profiles of the zipper for slider insertion, and to secure the zipper when the slider is inserted onto the zipper. A loading rack with a supply of sliders may be part of the slider insertion apparatus, with the loading rack being a mechanically attachable device.

SUMMARY OF THE INVENTION

The instant invention describes a zipper lubricating applicator device, and system, for dispensing a lubricant to one or more components of a zipper. The zipper lubricating applicator device contains a main body having a lubricant receiving cavity constructed and arranged to receive a lubricant reservoir, including a selectively pressurized lubrication reservoir which requires some action, i.e. squeeze of a tube or pressing a nozzle, by the user in order to dispense the lubricant. A lubricant dispensed from the lubricant reservoir is received by the lubricant receiving cavity and is directed to a zipper receiving channel. The main body may also contain at least one inner lumen. In this embodiment, the inner lumen further provides a pathway for a lubricant from the lubricant reservoir receiving cavity to a zipper receiving channel. The lubricant is dispersed at a controlled rate and onto a desired portion of a zipper. The zipper receiving channel is constructed and arranged to provide dispensing of the lubricant to a portion of a zipper as the applicator device slidably moves upon a zipper track. The instant invention further describes systems for applying a lubricant to a zipper track.

The instant invention also describes a zipper lubricating applicator system, which includes a zipper lubricating device having an upper plate and a lower plate connected by a vertical connecting block. The zipper lubricating device is further constructed and arranged for receipt of multiple zipper tracks through the multiple zipper receiving channels such that movement of the zipper lubricating applicator device in one direction results in the linking of the zipper interlocking teeth and movement in the opposite direction results in unlinking of the zipper interlocking teeth, at least one lubricant receiving port, a lubricant applicator body receiving structure constructed and arranged for receipt of a lubricant applicator body. The system further contains a lubricant applicator body having a first end constructed and arranged to engage the lubricant applicator body receiving structure, a second end constructed and arranged to receive a selectively pressurized lubrication reservoir, and an inner cavity for providing fluid communication between the multiple zipper receiving channels and the selectively pressurized lubrication reservoir.

Accordingly, it is a primary objective of the instant invention to provide a zipper lubricating applicator device for dispensing a lubricant to one or more components of a zipper.

It is a further objective of the instant invention to provide a zipper lubricating applicator device which controllably dispenses a desired amount of lubricant to a zipper portion.

It is yet another objective of the instant invention to provide a zipper lubricating applicator device which controllably dispenses a desired amount of lubricant to a desired location along a zipper track.

It is a still further objective of the invention to provide a zipper lubricating applicator device which dispenses lubricant while being slidably engaged with a zipper track.

It is yet another objective of the instant invention to provide a zipper lubricating applicator device which is mountable on various commercially available lubricant reservoirs.

It is a still further objective of the instant invention to provide a zipper lubricating applicator device which dispenses a lubricant in the form of a liquid, gel, or aerosol to a zipper track.

It is a further objective of the instant invention to provide a system for applying a zipper lubricant to a zipper track.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
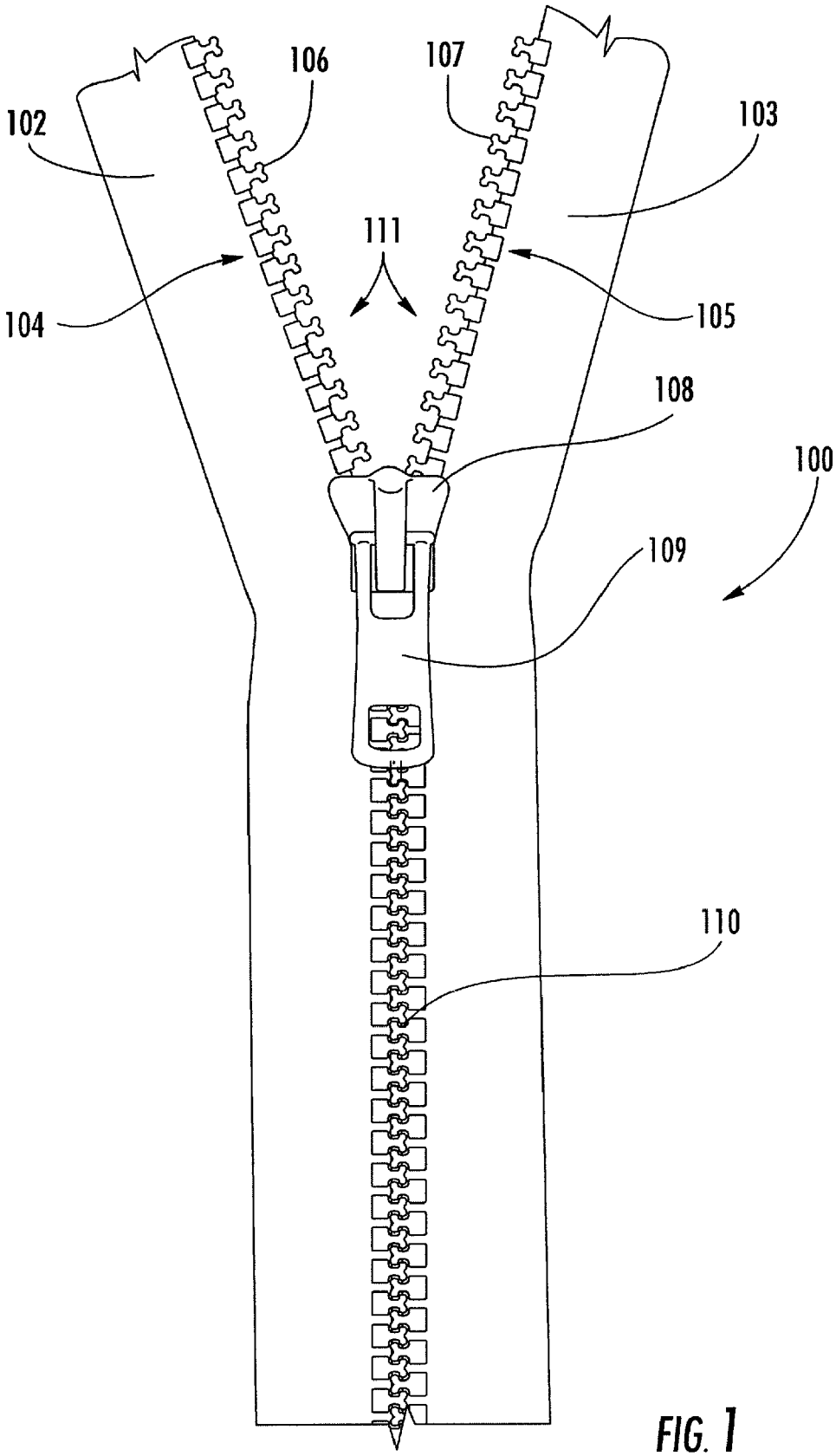
FIG. 1 is a common zipper fastener system, illustrating common components that make up the system.

Illustrated in FIG. 1 is a common zipper fastener found on clothing items. The zipper fastener 100 contains a pair of opposing tapes 102 and 103. Positioned on the tapes are opposing tracks 104 and 105 having interlocking teeth, 106 and 107 respectively. A slider 108 with a pulling device 109 moves along the opposing interlocking teeth to either lock, 110 or unlock, 111, teeth 106 and 107 as slider 108 moves up and down tracks 104 and 105.

The instant invention describes a zipper lubricating applicator device for dispensing a lubricant and/or other substances, such as but not limited to anti-oxidants for protecting and preserving the zipper parts, ultraviolet (UV) protectants for protection against wear and fading and restoration of natural coloring, or water proofing/water resistant materials, to one or more components of a zipper. The zipper lubricating applicator device contains a main body having a lubricant receiving cavity constructed and arranged to receive or be connected to a lubricant reservoir, including a selectively pressurized lubrication reservoir which requires some action, i.e. squeeze of a tube or pressing a nozzle of a spray can, by the user in order to dispense the lubricant. The applicator device may further include one or more inner lumens. A lubricant dispensed from the selectively pressurized lubrication reservoir is received by the lubricant receiving cavity and is directed to at least one inner lumen. The inner lumen provides a pathway for the lubricant as it travels from the lubricant receiving cavity to a zipper receiving channel. Use of the inner lumen provides the ability to disperse the lubricant at a controlled rate and onto a desired portion of a zipper. In an alternative embodiment not including the lumen, the lubricant receiving cavity is fluidly connected to the zipper receiving channel directly. The zipper receiving channel is constructed and arranged to provide dispensing of the lubricant to a portion of a zipper as the applicator device slidably moves along the zipper track. While FIG. 1 illustrates a common clothing zipper, the instant invention is designed to work with all zipper types known to one of skill in the art, including but not limited to coil zippers (both spiral form and ladder form), invisible, metallic, plastic-molded, open-ended, closed-ended, or the like.

Figure 2A:
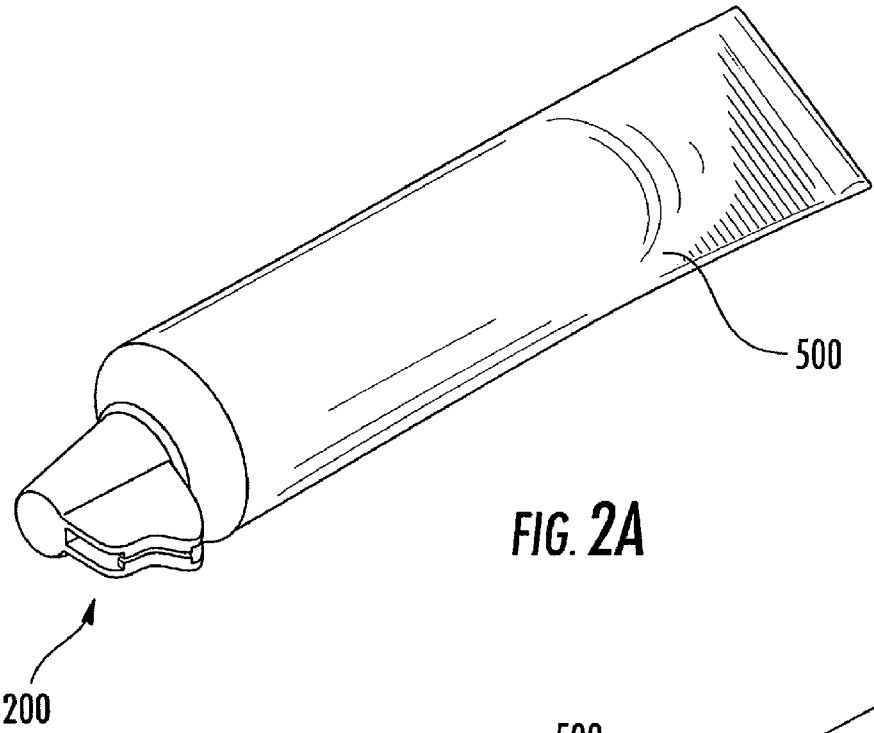
FIG. 2A illustrates a zipper lubricating applicator device attached to a lubricant reservoir.
Figure 2B:
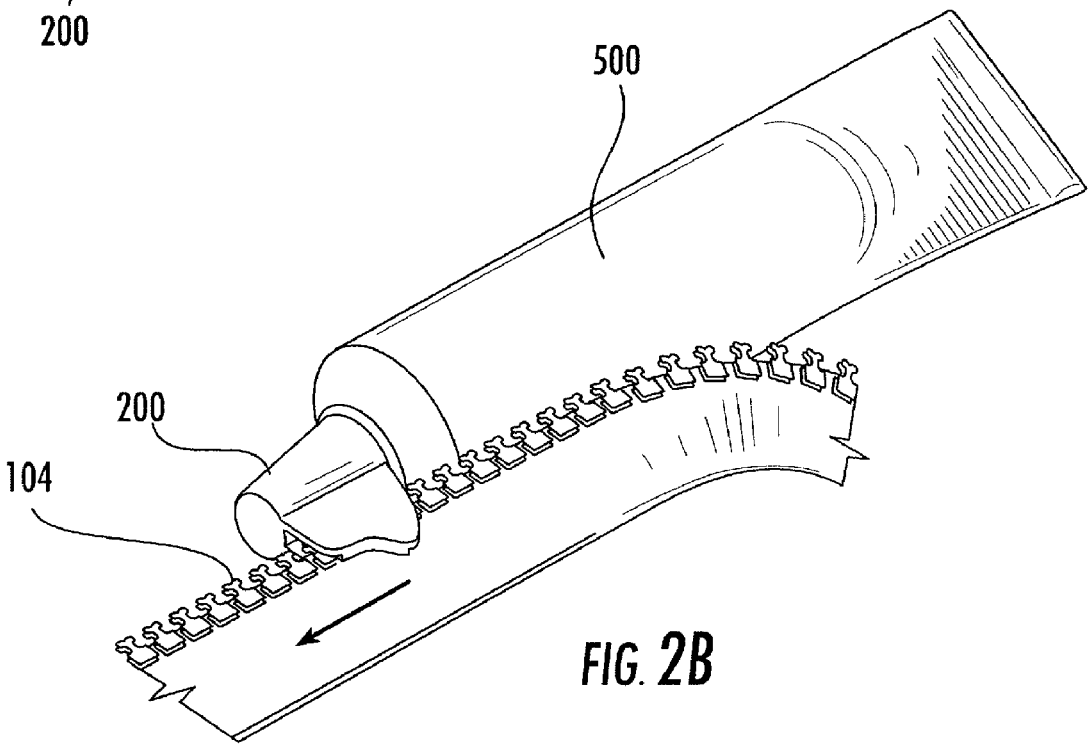
FIG. 2B illustrates a zipper lubricating applicator device engaged with a zipper track.

The advantage of the instant invention is that the device is designed to attach directly to a commercially available lubricant reservoir and provide the user a safe, fast, and effective manner in which to apply lubricants and/or other zipper protecting materials. A common lubricant used for zipper applications is polytetraflouroethylene and is sold as a gel-like substance. In this form, application to a zipper can be difficult to apply without using ones' hands, paper or common applicator tips. Using paper or common applicator tips is not effective because as the paper or applicator tip slides across the teeth of the zipper, the teeth of the zipper catches. Using fingers may be effective, but such technique is messy and increases the risk of damaging the material attached to the zipper. The applicator device described herein is designed to dispense different lubricant forms and attach to different dispensing reservoirs. FIG. 2A illustrates zipper lubricating applicator device 200 attached to a selectively pressurized lubrication reservoir 500. The device is further designed to engage and securely fasten onto a portion of the zipper system to disperse lubricant to a desired location as it slideably moves along the zipper track. FIG. 2B illustrates selectively pressurized lubrication reservoir 500 attached with zipper lubricating applicator device 200 positioned along a zipper track, 104.

Figure 3A:
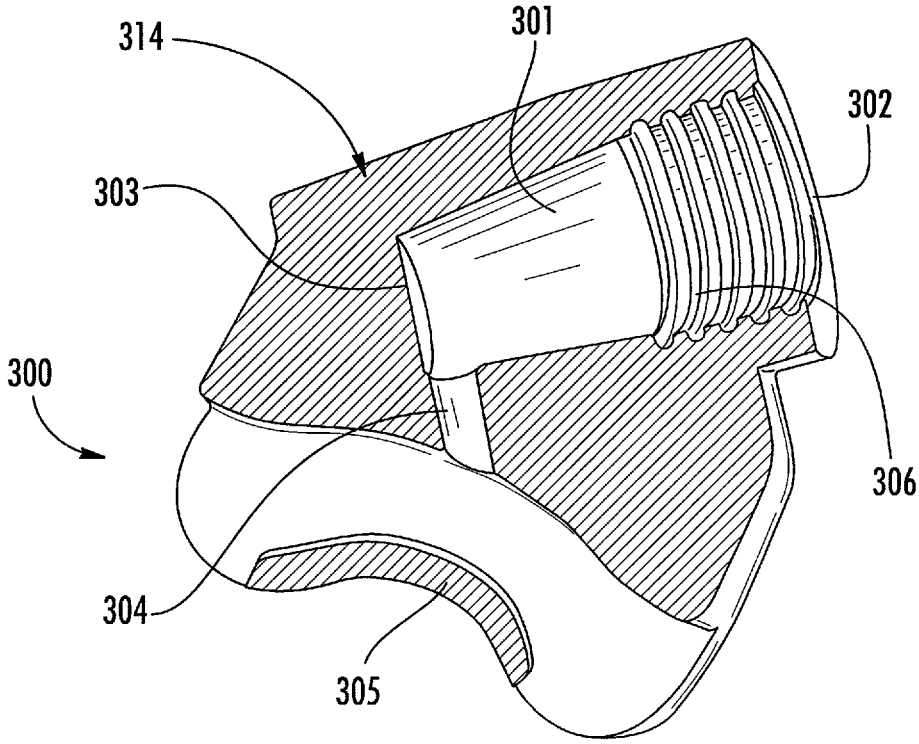
FIG. 3A illustrates a cross sectional view of a particular embodiment of the zipper lubricating applicator device.

FIG. 3A illustrates a cross sectional view of a particular embodiment of the applicator device. Applicator device 300 includes a main body 314 having a lubricant receiving cavity 301. Cavity 301 includes an open end, 302, and a closed end, 303. Although FIG. 3A illustrates cavity 301 as substantially cylindrically shaped and includes a tapered end, cavity 301 may be constructed to any shape, size, or configuration. Depending on the overall design of the applicator device, the cavity can be positioned in any orientation, such as directly through the center, off-centered, or at various angles. Lubricant receiving cavity 301 is designed to receive or be connected to a selectively pressurized lubrication reservoir through insertion of opening 302. Because many commercial lubricant reservoirs come with a dispensing top having male/female threading, threading 306 can accommodate a reservoir with such feature. However, the cavity does not require the threading and can be designed to attach in other ways, such as a snap lock or providing a tight fit or pressure/frictional fit between the cavity and dispensing element. Connected to lubricant receiving cavity 301 is an inner lumen 304. Inner lumen 304 interconnects lubricant reservoir receiving cavity 301 with a zipper receiving channel 305 and provides a controllable mechanism in which to control the amount dispensed, depending on the type of lubricant to be dispensed. Therefore, inner lumen 304 may be sized, shaped and positioned within the applicator device according to the type of lubricant used and the amount of a lubricant to be dispensed. In an alternative embodiment, the applicator device may not utilize the inner lumen, in which case the cavity 301 is directly connected to the zipper receiving channel 305.

Figure 3B:
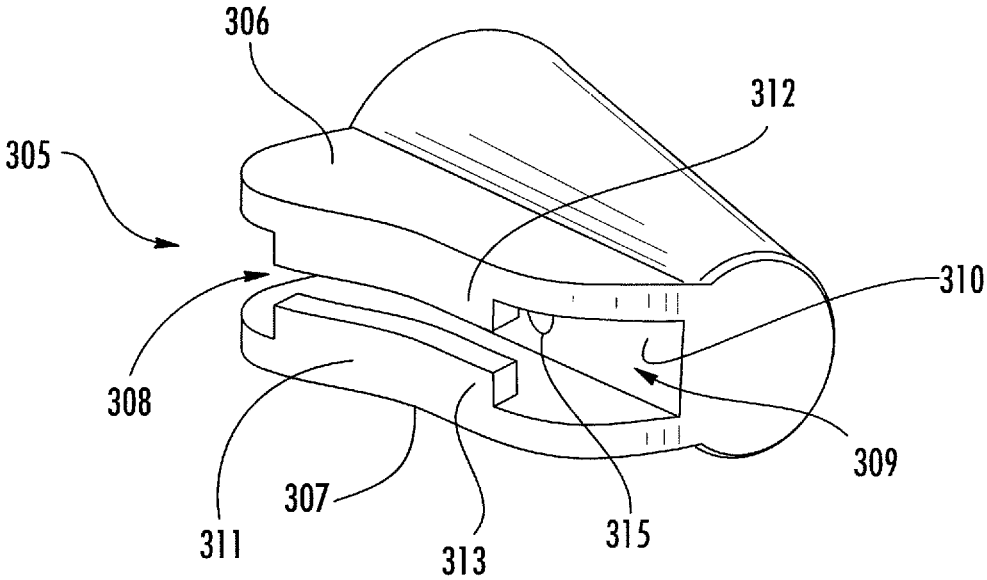
FIG. 3B illustrates a side view of the lubricating applicator device, particularly highlighting the various components of the zipper receiving channel.

Zipper receiving channel 305 is constructed in such a manner as to provide applicator device the capability of slidable movement along a portion of a zipper fastener, such as the fastening elements of the zipper track. As illustrated in FIG. 3B, zipper receiving channel 305 has a generally rectangular-shaped cross-section and can be defined by an upper surface, lower surface, two side lateral walls, and two open ends. Upper surface 306 is formed as an integral part of the top surface of the applicator tip. Bottom surface 307 is formed as an integral part of the bottom surface of the applicator tip. The sides of the zipper receiving channel 305 have two open ends, 308 and 309. Open ends 308 and 309 provide a mechanism for insertion of the zipper track and slidable movement along the zipper fastening elements. The lateral sides of zipper receiving channel 305 are defined by a first wall, 310, and a partially closed second side wall, 311. The second side wall is formed from an upper guide rail 312 and a lower guide rail 313. A portion of the second side wall contains a curvature, but may also be straight. Upper and lower guide rails may contain curvature as well. Inserting a zipper track within the channel provides a guide as the applicator device slideably engages the zipper track. While the zipper receiving channel is illustrated as dispensing lubricant onto one zipper track, the zipper receiving channel may be adapted to contain multiple zipper receiving channels inn order to dispense lubricant to multiple tracks. Zipper receiving channel 305 further contains an opening, 315, which provides a pathway for the lubricant as it travels from the lubricant receiving cavity and/or the inner lumens. In a particular embodiment, the zipper receiving channel is made of a flexible material, such as a flexible plastic, such that the device can be inserted anywhere along a zipper track, yet remain firm enough to engage the zipper track.

Figure 4:
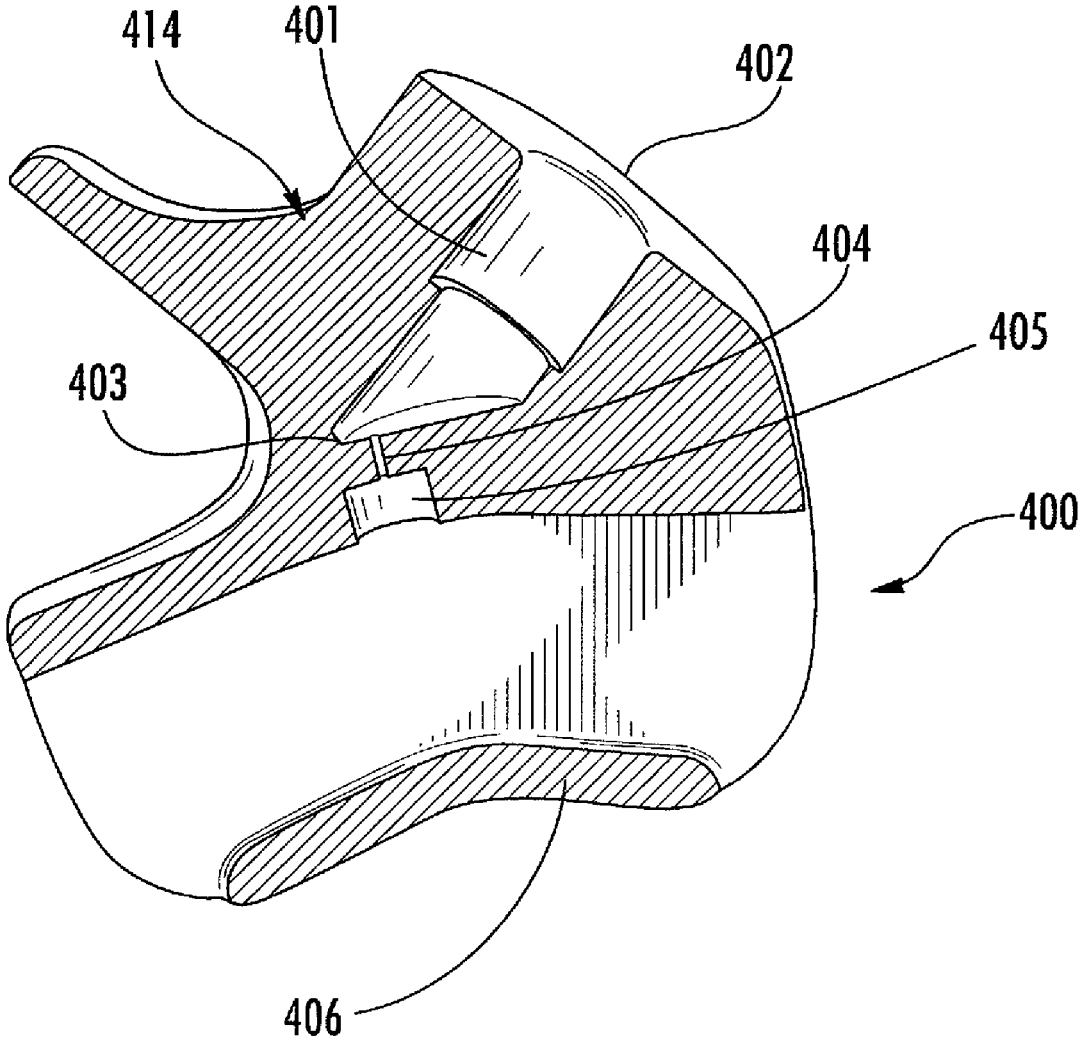
FIG. 4 illustrates a cross sectional view of a second embodiment of the lubricating applicator device.

A unique aspect of the zipper applicator is that it can be modified to engage any type of commercially available lubricant reservoir. FIG. 4 illustrates a second embodiment of the lubricating applicator device. The design of this applicator device provides dispensing of a lubricant housed in a spray can, allowing the user an ability to controllably channel lubricants in the form of an aerosol to the desired section of the zipper as the applicator device slides along the zipper track. Applicator device 400 includes a main body 414 having a lubricant receiving cavity 401. Cavity 401 includes a first open end 402 and a second closed end, 403. Cavity 401 is substantially cylindrically shaped and may include a tapered end. Connected to lubricant reservoir receiving cavity 401 is a first inner lumen 404. First inner lumen is connected to a second inner lumen, 405. Inner lumens 404 and 405 interconnect lubricant reservoir receiving cavity 401 with a zipper receiving channel 406. Zipper receiving channel 406 is constructed in such a manner that provides slideable movement along a portion of a zipper fastener, such as the interlocking elements of a zipper track and has the same general design as described previously. Lubricant receiving cavity 401 can be designed in such a manner to receive a lubricant dispensing device, such as a spray can, through insertion of open end 402, i.e. snap lock. Alternatively, the main body may not include one or more inner lumens, in which case the cavity 401 is directly connected to zipper receiving channel 406.

Figure 5A:
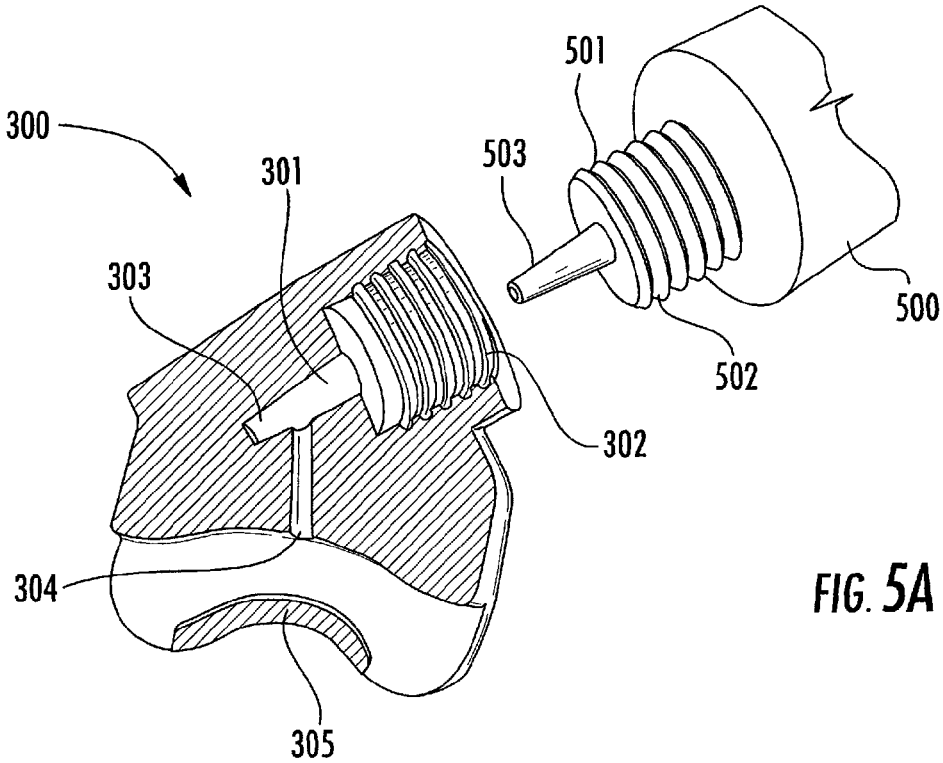
FIG. 5A illustrates a cross sectional view of the zipper lubricant applicator device with a lubricant reservoir.
Figure 5B:
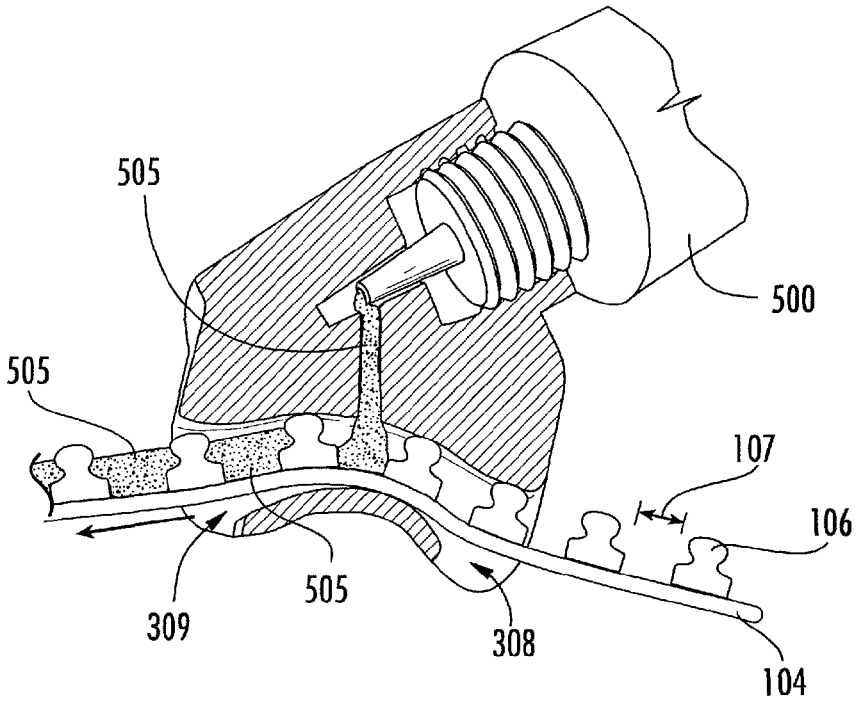
FIG. 5B shows the zipper lubricant applicator with lubricant reservoir, illustrating flow of lubricant as the device is moved along a zipper track.

FIGS. 5A and 5B illustrate operation of the lubricating applicator device and selectively pressurized lubrication reservoir. Referring to FIG. 5A, selectively pressurized lubrication reservoir 500 includes a dispensing element 501 positioned at one end of the reservoir. Dispensing element 501 of selectively pressurized lubrication reservoir is illustrated as having threading 502 and a dispensing tip 503. In use, lubrication reservoir is inserted into applicator device 300 by insertion of dispensing tip 503 through opening 302 and into the lubricant receiving cavity 301. Threading 502 of dispensing element 501 is designed to engage the threading of lubricant receiving cavity 301 such that when either applicator device 300 or selectively pressurized lubrication reservoir 500 is rotated, the two elements are secured to each other. Applicator device 300 is designed such that when the pressurized lubrication reservoir 500 is inserted and/or rotated completely, dispensing tip 503 is sealed against the back portion 303 of lubricant receiving cavity 301. In this embodiment, lubricant receiving cavity 301 is designed such that the back end extends past inner lumen 304. By sealing dispensing device 503 to the back end portion 303, the applicator device remains connected with the selectively pressurized lubrication reservoir without increasing the risk that the contents within the reservoir may become dried out, contaminated, or leak. Full rotation of the applicator device into the dispensing element results in the dispensing device moving past the inner lumen and resting against the back end of the cavity. To dispense the contents of the selectively pressurized lubrication reservoir, the applicator device or dispensing reservoir is rotated in the opposite direction until the dispensing device rests at or near the inner lumen. Pressure applied against the selectively pressurized lubrication reservoir provides the force necessary to expel lubricant out of the lubricant reservoir through the dispensing element. The lubricant is then dispensed into the inner cavity and through inner lumen 304 to the zipper receiving channel 305. The zipper receiving channel engages the zipper and provides slidable movement without moving off the zipper track or teeth.

FIG. 5B illustrates the applicator device engaged with the interlocking elements 106 of zipper track 104 through insertion via zipper receiving channel openings 308 and 309. Dispensing of lubricant 505 out of the selectively pressurized lubrication reservoir dispensing element and into inner lumen 304 (FIG. 5A) provides the mechanism of controllable and directed application to any portion of the zipper system, including on the interlocking elements 106 or within the spaces between, 107, of the individual interlocking elements. As the interlocking elements are inserted into the zipper receiving channel, upper and lower surface guide rails 312 and 313, respectively (see FIG. 3B), engage the interlocking element, thus keeping the zipper receiving channel engaged with the track as the applicator device/lubricant reservoir slides along the track dispensing the lubricant. The curvature of the guide rails and/or the zipper receiving channel exerts a force against the individual interlocking elements as the zipper lubricating device moves along the zipper track. The force exerted upon the interlocking elements results in the individual interlocking elements being pushed upwardly, closer to the area of the device where the lubricant is being dispensed. As the guide rails push the interlocking elements up, the individual interlocking elements also diverge or separate such that the area between adjacent interlocking elements is larger than when not engaged with the device. As the device moves further along the zipper track and engages other interlocking elements, the non-engaged with the interlocking elements re-align to their original position, but fill, either partially or completely, with lubricant.

While the previous embodiments describe lubricating applicator devices constructed to connect with independent lubricant reservoirs, the applicator devices may be commercially available as a system, including the applicator device attached to a lubricant reservoir. The system may be constructed as one piece which is then filled with a desired lubricant. Alternatively, the applicator device can be constructed separately and attached to a pre-filled lubricant reservoir prior to packaging of the product.

Figure 6A:
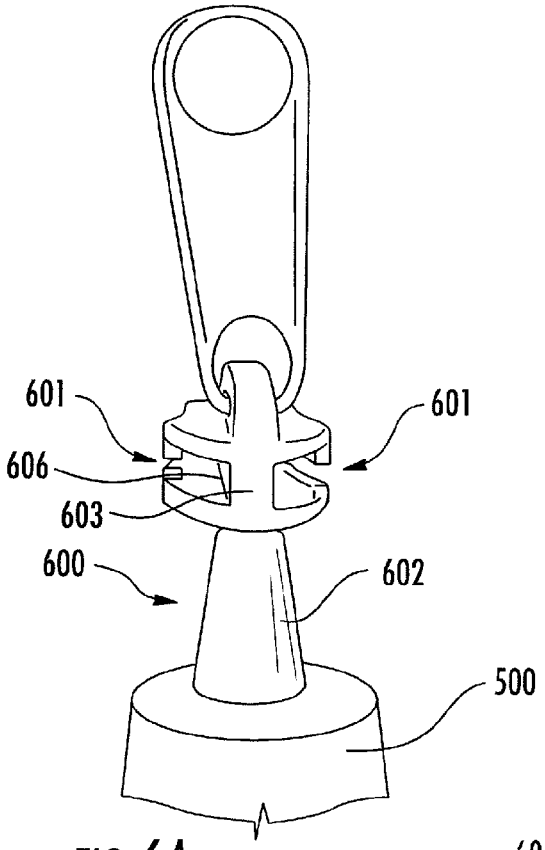
FIG. 6A illustrates an alternative embodiment of the zipper lubricating device as described in a system, including multiple zipper receiving channels, a lubricant applicator body, and a selectively pressurized lubrication reservoir.
Figure 6B:
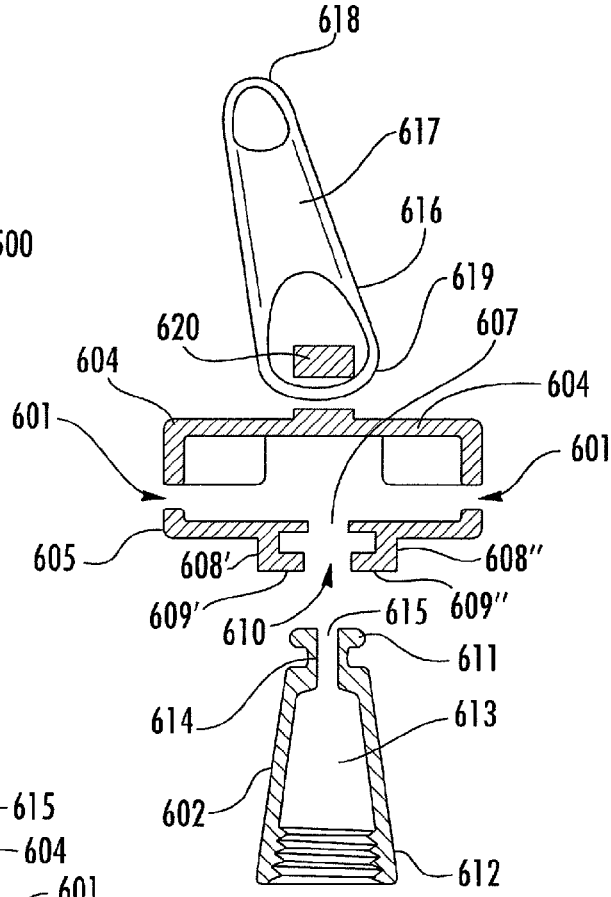
FIG. 6B is a cross sectional views of the zipper lubricating device of 6A without a selectively pressurized lubrication reservoir, illustrating a particular embodiment of the lubricant applicator body connecting element for receipt of a lubricant applicator body and an applicator body.
Figure 6C:
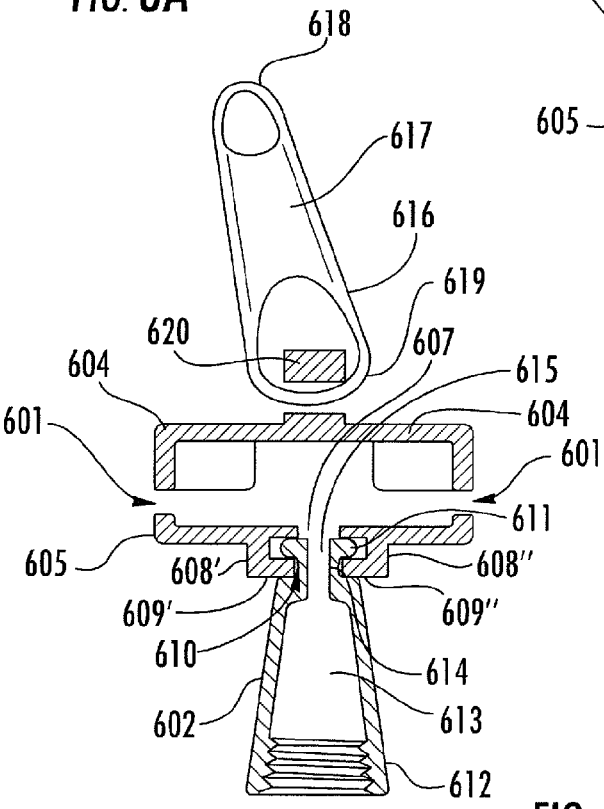
FIG. 6C is a cross section view of zipper lubricating device of 6A without a selectively pressurized lubrication reservoir, illustrating engagement of the lubricant applicator body connecting element and the lubricant applicator body.

FIGS. 6A, 6B, and 6C illustrate several aspects of a particular embodiment of a zipper lubricating system, 600, including multiple zipper receiving channels, 601, a lubricant applicator body, 602, and a selectively pressurized lubrication reservoir 500. As illustrated in FIG. 6B, the zipper lubricating device contains multiple zipper receiving channels, 601, which are constructed and arranged to allow multiple zipper tracks to interconnect together or separate depending upon the direction of the movement. In this manner, the zipper lubricating device functions as both a traditional zipper slider by opening and closing the zipper interlocking elements, or teeth, and as a lubricating device. As described previously, zipper lubricating device contains one or more zipper receiving channels which include first and second open ends and one or more guide rails which may contain a curvature. The zipper lubricating device further includes a vertical connecting block, 603, which interconnects a lubricating device upper plate 604 and a lubricating device lower plate 605. As illustrated, upper and lower plates are connected in a parallel manner. Vertical connecting block 603 may extend longitudinally along the upper and lower plates along the entire length of plates 604 and 605. In a preferred embodiment, vertical connecting block 603 extends partially, 606, along the upper and lower plates to create two Y-shaped channels. The zipper lubricating device contains at least one lubricant receiving opening or port, 607. Attached to lower plate 605 are elements 608 and 609 which define a lubricant applicator body receiving structure, 610, for receipt of a lubricant applicator body.

Main body 602 includes a first end, 611, constructed and arranged to engage a lubricant applicator body connecting element 610, a second end, 612, constructed and arranged to receive a selectively pressurized lubrication reservoir, and an inner cavity 613 for providing fluid communication between the multiple zipper receiving channels and the selectively pressurized lubrication reservoir. Main body 602 further includes at least one inner lumen, 614, which terminates in at least one opening, 615, along first end 611. Alternatively, main body 612 may not include an inner lumen, in which case opening 615 is connected to cavity 612, providing fluid communication between the multiple zipper receiving channels and the selectively pressurized lubrication reservoir. Lubricant applicator body connecting element 610 has a generally T-shaped cross section and is defined by the lubricating device lower plate 605, a parallel wall, separated into 608' and 608" (collectively 608) by an opening, and two lateral side walls 609' and 609" (collectively 609) attached to 608' and 608' respectively. As illustrated in FIG. 6C, main body 602 engages the lubricant applicator body connecting element 610 and is held in place by structures 608 and 609 such that opening 615 positioned along first end 611 of the main body 602 aligns with at least a portion of lubricant receiving port 607. Second end 612 engages with a selectively pressurized lubrication reservoir through various means such as frictional fitting, or by containing male or female threading. Movement of the device along a zipper track is accomplished by attachment of a pulling tab, 616. As illustrated, pulling tab has an elongated body 617 having a first looped end 618 and a second looped end 619 which pivotally couples to a zipper pull coupling element 620 attached to upper plate 604. The system described above is useful for situations in which the user desires a functional zipper device, i.e. lock/unlock zipper teeth, which also functions as a zipper lubricant dispensing device to be placed on a zipper track. If the user desires to lubricate or treat the zipper track, a lubricant applicator body can be inserted into the lubricant applicator connecting element which can be used to dispense lubricant upon the zipper teeth as the device slides along the zipper track.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A zipper lubricating applicator device for dispensing a lubricant to one or more components of a zipper comprising: a main body having a lubricant receiving cavity constructed and arranged for connection to a selectively pressurized lubrication reservoir, said lubricant receiving cavity being fluidly connected to a zipper receiving channel; said zipper receiving channel having a curved surface, an upper and lower surface, a first open end for receipt of said zipper track and a second open end for providing movement along said zipper track, whereby a lubricant dispensed from said selectively pressurized lubrication reservoir into said lubricant receiving cavity is directed to said zipper receiving channel and dispensed to a portion of said zipper as said zipper receiving channel slidably engages a zipper track.

2. The zipper lubricating applicator device for dispensing a lubricant to a zipper according to claim 1 wherein said main body further contains at least one inner lumen for providing fluid connection between said lubricant receiving cavity and said zipper receiving channel.

3. The zipper lubricating applicator device for dispensing a lubricant to a zipper according to claim 1 wherein said zipper receiving channel further contains at least one guide rail constructed and arranged to cooperate with said zipper track, thereby guiding said zipper receiving channel along said zipper track.

4. The zipper lubricating applicator device for dispensing a lubricant to a zipper according to claim 3 wherein said at least one guide rail is curved.

5. The zipper lubricating applicator device for dispensing a lubricant to a zipper according to claim 1 wherein said lubricant receiving cavity contains a threaded portion.

6. The zipper lubricating applicator device for dispensing a lubricant to a zipper according to claim 1 wherein said receiving cavity is connected to said selectively pressurized lubrication reservoir by a frictional fit.

7. The zipper lubricating applicator device for dispensing a lubricant to a zipper according to claim 1 wherein said zipper receiving channel is made of a flexible material.

8. The zipper lubricating applicator device for dispensing a lubricant to a zipper according to claim 1 wherein said lubricant dispensed is a gel.

9. The zipper lubricating applicator device for dispensing a lubricant to a zipper according to claim 1 wherein said zipper applicator device dispenses a lubricant from a spray can.

10. The zipper lubricating applicator device for dispensing a lubricant to a zipper according to claim 1 wherein said zipper lubricating applicator device has multiple zipper receiving channels.

11. The zipper lubricating applicator device for dispensing a lubricant to a zipper according to claim 1 wherein said zipper applicator device dispenses a gel or aerosol lubricant.

12. A system for lubricating a zipper comprising:

a zipper lubricating applicator device, said zipper lubricating applicator device including a main body having a lubricant receiving cavity constructed and arranged for connection to a selectively pressurized lubrication reservoir, said selectively pressurized lubricant receiving cavity being fluidly connected to a zipper receiving channel, said zipper receiving channel having a curved surface, an upper and lower surface, a first open end for receipt of said zipper track and a second open end for providing movement along said zipper track, whereby a lubricant dispensed from said selectively pressurized lubrication reservoir into said lubricant receiving cavity is directed to said zipper receiving channel and dispensed to a portion of said zipper as said zipper receiving channel slidably engages said zipper track; and a selectively pressurized lubrication reservoir.

13. The zipper lubricating applicator device for dispensing a lubricant to a zipper according to claim 12 wherein said main body further contains at least one inner lumen for providing fluid connection between said lubricant receiving cavity and said zipper receiving channel.

14. The zipper lubricating applicator device for dispensing a lubricant to a zipper according to claim 12 wherein said zipper receiving channel further contains at least one guide rail constructed and arranged to cooperate with the said zipper track, thereby guiding said zipper receiving channel along said zipper track.

15. The zipper lubricating applicator device for dispensing a lubricant to a zipper according to claim 14 wherein said at least one guide rail is curved.

16. The zipper lubricating applicator device for dispensing a lubricant to a zipper according to claim 12 wherein said lubricant receiving cavity contains a threaded portion.

* * * * *